United States Patent [19]

Janopaul, Jr.

[11] Patent Number: 5,044,834

[45] Date of Patent: Sep. 3, 1991

[54] RETAINING WALL CONSTRUCTION AND BLOCKS THEREFOR

[75] Inventor: Peter Janopaul, Jr., Modesto, Calif.

[73] Assignee: Graystone Block Co., Inc., Modesto, Calif.

[21] Appl. No.: 557,956

[22] Filed: Jul. 26, 1990

[51] Int. Cl.[5] ..... E02D 29/02

[52] U.S. Cl. ..... 405/284; 52/169.4; 52/562; 52/585; 405/262; 405/286

[58] Field of Search ..... 52/585, 586, 608, 611, 52/562, 169.4, 170, 606, 609; 405/284, 285, 286

[56] References Cited

U.S. PATENT DOCUMENTS

| | | | |
|---|---|---|---|
| 4,802,320 | 2/1989 | Forsberg | 52/585 |
| 4,824,293 | 4/1989 | Brown et al. | 405/286 |
| 4,825,619 | 5/1989 | Forsberg | 52/562 |
| 4,914,876 | 4/1990 | Forsberg | 52/562 |
| 4,920,712 | 5/1990 | Dean, Jr. | 52/98 |

FOREIGN PATENT DOCUMENTS

| | | | |
|---|---|---|---|
| 527565 | of 1921 | France | 52/585 |
| 930603 | of 1947 | France | 52/606 |

*Primary Examiner*—Richard E. Chilcot, Jr.
*Assistant Examiner*—Robert J. Canfield
*Attorney, Agent, or Firm*—Baylor G. Riddell

[57] ABSTRACT

In general, a block and retaining wall formed by a number of such blocks are interconnected between courses by a plurality of Z-shaped anchor elements having an upper and lower body part of substantially rectangular cross-section as viewed in plan. The upper body part is offset from the lower body part. The offset of one course of blocks relative to the course beneath will be a predetermined fixed amount determined by the offset of the body parts of the interlocking Z-shaped anchor elements. A tie-back arrangement includes means for attaching a sheet of geosynthetic material to the embedded end of a block so as to leave the open cells within and those formed between the blocks unobstructed from above and available for filling with pea gravel or other drainage fill material.

9 Claims, 6 Drawing Sheets

FIG 1
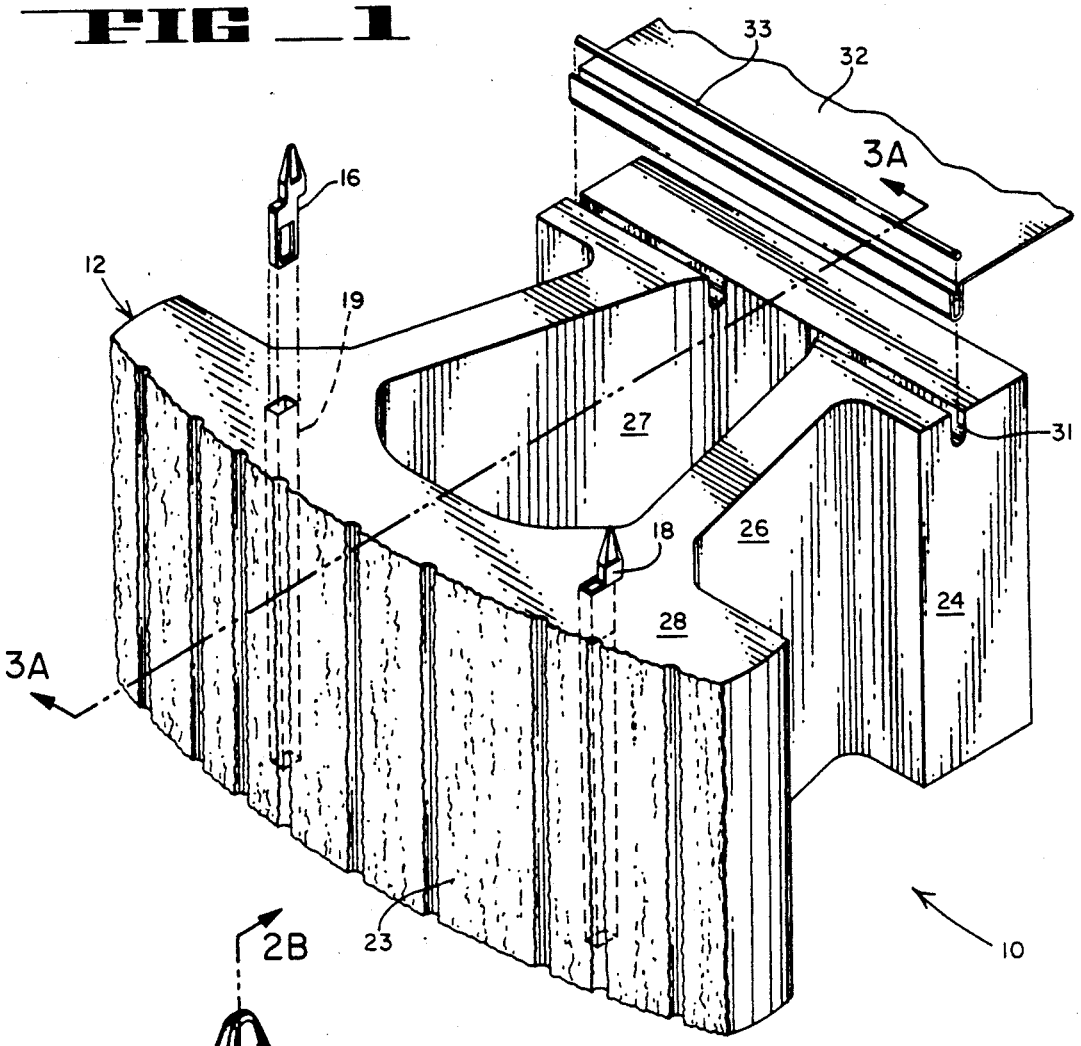
FIG 2B
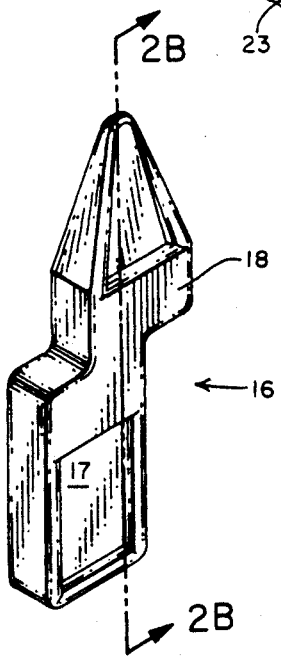
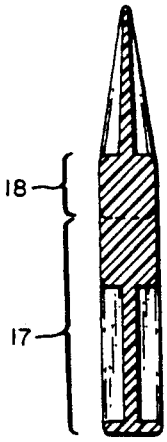
FIG 2A

D14

RETAINING WALL CONSTRUCTION AND BLOCKS THEREFOR

FIELD OF INVENTION

This invention pertains to wall blocks and a block wall construction and to such blocks particularly suitable in making retaining walls for securing terraces and embankments.

BACKGROUND OF THE INVENTION

Conventional retaining walls are used to secure earth embankments against sliding and slumping. Retaining walls are made of various types of concrete, solid masonry, wood ties, bricks and blocks of stone and concrete. The blocks are placed in rows and superimposed on top of each other to form a wall. An example of blocks used in the construction of retaining walls is shown by Forsberg in U.S. Pat. No. 4,914,876. The foregoing patent discloses blocks stacked in a plurality of courses or layers interlocked by means of elongate pins extending up through a block and into a shallow elongate pocket disposed in the under surface of the next course of blocks.

In addition, a tie-back arrangement has been shown whereby a geogrid sheet is retained by the interconnecting pins. Thus the presence of the geogrid sheet buried in the retained soil behind the wall serves to stabilize the wall and soil.

However, use of the pins as the holding means serves to cause the geogrid sheet to block off the otherwise open cells of the wall. These open cells normally are loaded with pea gravel or other drainage material.

The geogrid sheet, when held as above described, can cause the smaller sizes of drainage material to "bridge" openings of the sheet and prevent complete filling of the open cells. This lack of complete filling can allow the retained earth behind the wall to invade the unfilled cell and prevent proper drainage or cause settlement of the retained earth behind the wall.

In addition, use of the interlocking pin arrangement, as shown in the above patent, leaves the degree of backward and upward slope in the face of the wall in the hands and eye of the worker whereby such slope will generally be inconsistent or erratic along the length thereof.

Furthermore, using the pins to hold or retain a sheet of geotextile fabric material requires two holes to be punched in the geotextile fabric. The position of these holes must be accurately located with proper spacing between. Otherwise, the holes for the pins in the block will not line up with the holes in the geotextile fabric.

Thus, use of such tieback material attached at the front of the block (as in the above patent) dictates that pea gravel or other drainage material must be filled into the open cells of the block (or formed between blocks) before attachment of the tieback material.

SUMMARY OF THE INVENTION AND OBJECTS

In general, this invention comprises an improved construction block and retaining wall made therefrom. The courses of blocks are interlocked by an improved interlocking device, hereafter a "Z" anchor, which serves to offset each adjacent upper layer of blocks by a predetermined degree so as to define the degree of the predetermined backward and upward slope in the face of the wall.

In addition, an improved means for securing geosynthetic material to protrude from the back side of the wall into soil behind the wall can be characterized by an elongate slot formed crosswise into the top surface of the block.

In general it is an object of the present invention to provide an improved wall block and retaining wall construction.

Another object of the invention is to provide an improved retaining wall construction made from wall blocks and having improved means for providing a tie-back function to various portions of the wall.

Yet another object of the invention is to provide a retaining wall construction from such blocks having improved interlocking means between successive courses of blocks whereby a retaining wall so made will have a predetermined upward slope.

Yet a further object of the invention is to provide an improved interlocking element for use in conjunction with wall blocks.

The foregoing and other objects of the invention will become more readily evident from the following detailed description of a preferred embodiment when considered in conjunction with the drawings.

This anchoring of the geosynthetic material at the rear of the retaining wall block eliminates the problem of placing drainage material into the now open unobstructed cavities of the block wall, i.e. ¾" rock can now be used as a substitute for pea gravel which will do a better job of drainage more economically, and allow the filling to be done at any time as opposed to tying it to the placement of the tieback material.

BRIEF DESCRIPTION OF THE DRAWINGS

FIG. 1 shows a diagrammatic exploded perspective view of a wall block for use in constructing a retaining wall according to the invention;

FIG. 2A shows a diagrammatic perspective view of an interlocking element as used in conjunction with the wall block of FIG. 1;

FIG. 2B shows a side elevation view in section taken along the line 2B—2B of FIG. 2A;

DETAILED DESCRIPTION OF PREFERRED EMBODIMENTS

Figure 6A:
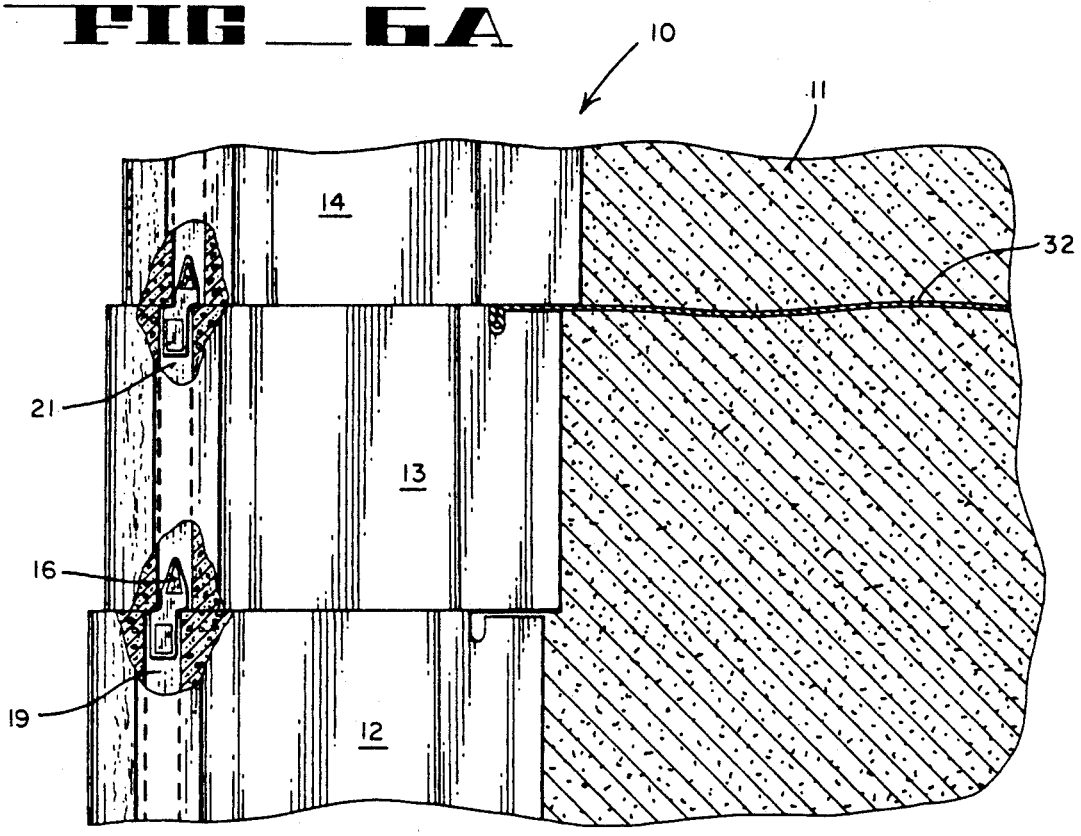
FIG. 6A shows an enlarged side elevation section view of three courses in the retaining wall shown in FIG. 4 with portions broken away for clarity.
Figure 6B:
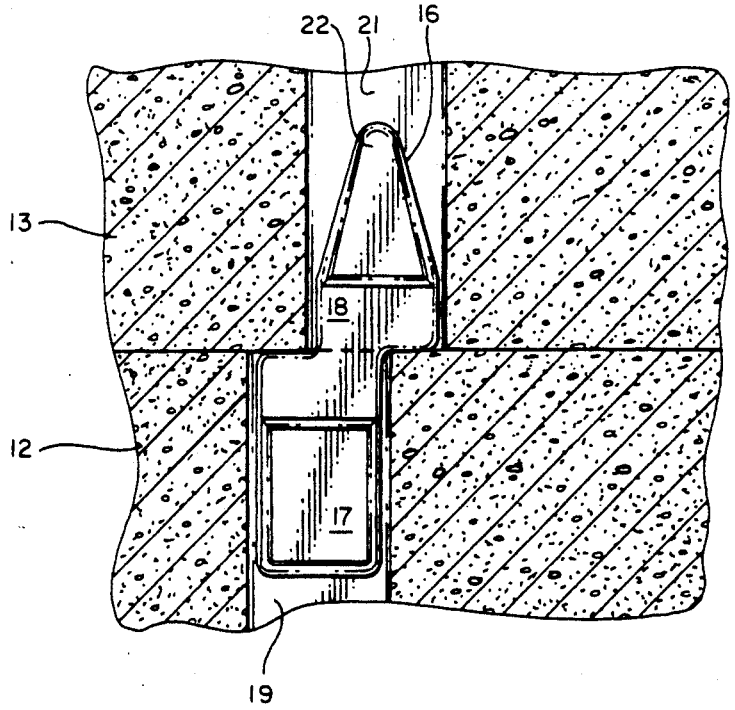
FIG. 6B shows an enlarged detail of an interlocking element disposed between vertically adjacent blocks of a retaining wall defining the offset which is provided to the upper course of blocks.
Figure 6C:
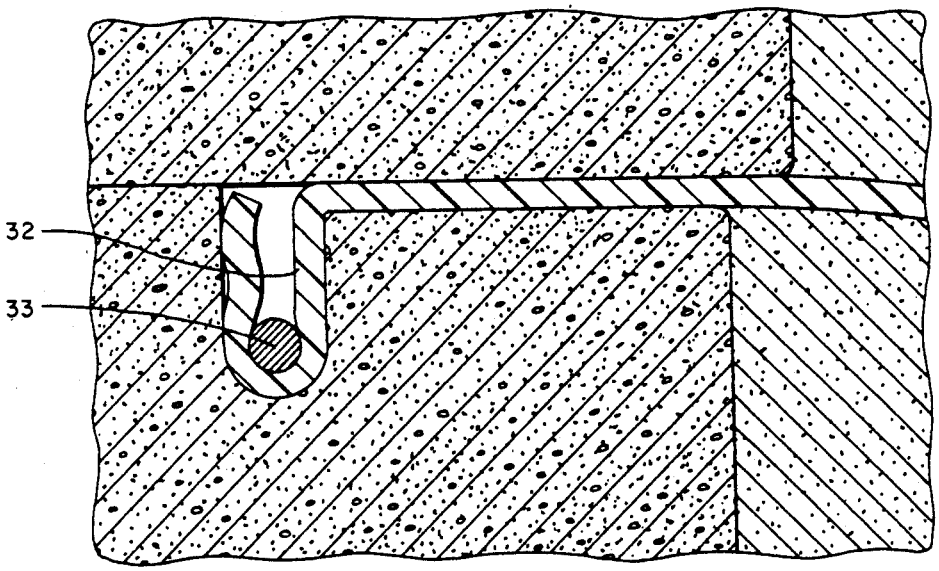
FIG. 6C shows an enlarged detail of a means for retaining a geogrid sheet to a portion of the blocks.

As shown in FIGS. 6A through 6C an improved retaining wall construction 10 serves to hold back a volume of earth 11. Retaining wall 10 has been formed by a number of courses or layers of concrete blocks 12, 13, 14. While blocks 12 through 14 are identical they have been so numbered so as to refer to three successive courses of blocks of the retaining wall 10. Thus, as noted above, retaining wall 10 includes a number of courses, each course containing a number of concrete blocks 12, 13, 14. Wall construction 10 has a predetermined, upward slope established by means now to be described for interlocking the blocks 12, 13, 14 between courses and serving to define the degree of said slope. This interlocking means includes a plurality of Z anchors 16. Anchors 16 each include non-circular first and second elongate body parts 17, 18. Body part 17 includes, along the length thereof, a cross-section as viewed in plan having angles disposed at the periphery thereof so as to cooperate with and fit within a similar non-circular opening on the underside of a block 12, 13, 14 to inhibit rotation or mis-orientation of anchor 16 within its associated openings receiving the first and second body parts 17, 18.

More particularly, body part 17 includes, in plan, a generally rectangular periphery as does body part 18. However, this cross-section of body part 17 extends substantially the full length of part 17 whereas the rectangular plan configuration of body part 18 extends only along a limited length thereof. In addition, the first and second body parts 17, 18 are relatively offset with respect to each other by a predetermined degree whereby mounting of a block 13 onto elements 16 of a block 12 causes block 13 to be slightly offset whereby successive adjacent courses of blocks will become offset in a manner defining the degree of the upward slope of the wall.

Finally, anchor 16 fits within the bottom and upper elongate openings 19, 21 joined to extend through an associated block 12, 13. Openings 19, 21 are formed with a generally rectangular cross-section so as to prevent blocks 12, 13, 14 from rotating about the axis of a portion 17, 18 of anchor element 16.

As noted above, by means of the use of a rectangular cross-section for body parts 17, 18, it will be readily evident that the cross-section as viewed in plan has angle means disposed at the periphery thereof and shaped and dimensioned to conform to the inner side walls of the openings 19, 21. Body part 18 carries thereon a progressively upwardly reduced upper end portion 22 serving to guide body portion 18 into opening 21 exposed underneath one of the blocks, such as 13.

A block 12, as shown in FIG. 1, has been formed with an arcuate outer face 23, which should be primarily decorative in appearance. The opposite end of block 12 carries a generally rectangularly shaped body 24 of concrete supported by side walls 26, 27 extending between the backside of front face 23, at the quarter points thereof, and body 24.

As shown in FIG. 1, however, side walls 26, 27 connect at positions located somewhat inwardly from the ends of front face 23, preferably at the quarter points thereof, so as to provide an improved structure. The top and bottom surfaces 28, 29 of block 12 are generally flat. The foregoing block structure provides an improved construction in that extraneous nonfunctioning material has been eliminated, which also makes the blocks weigh less per square foot of wall surface, thereby resulting in reduced wall costs.

Further, tie-back means have been coupled to the blocks 12, 13, 14 and include an elongate slot 31 formed in the top of rectangular body 24. The open cells defined between side walls 26, 27 serve to contain a supply of pea gravel or other drainage material disposed therein. Accordingly, the tie-back means includes a sheet 32 of flexible tieback material which is preferably a strong polymer. Sheet 32 is retained in slot 31 by a semi-rigid wedging element, preferably, such as a pencil rod 33 of metal or plastic laid parallel to the plane of sheet 32 and driven to move in the plane of slot 31. In this way as shown best in FIG. 6C the pencil rod will press the opposite sides of sheet 32 to wedge same into slot 31.

The upper surface 24A of body 24 beyond slot 31 has been slightly reduced in height in order to accommodate the presence of sheet 32. This is primarily noted in FIG. 6C as well.

As noted above, openings, such as 19 and 21, can be the opposite ends of a pair of continuous passageways extending from the top surface 28 to the bottom surface 29 of block 12.

Figure 3A:
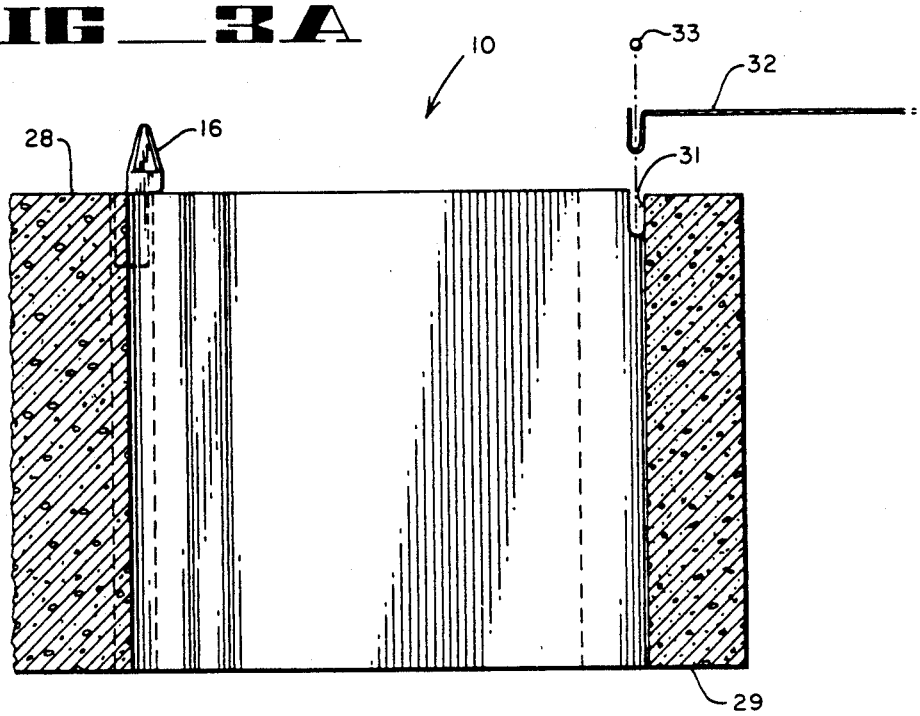
FIG. 3A shows an elevation section view taken along the line 3A—3A of FIG. 1.
Figure 3B:
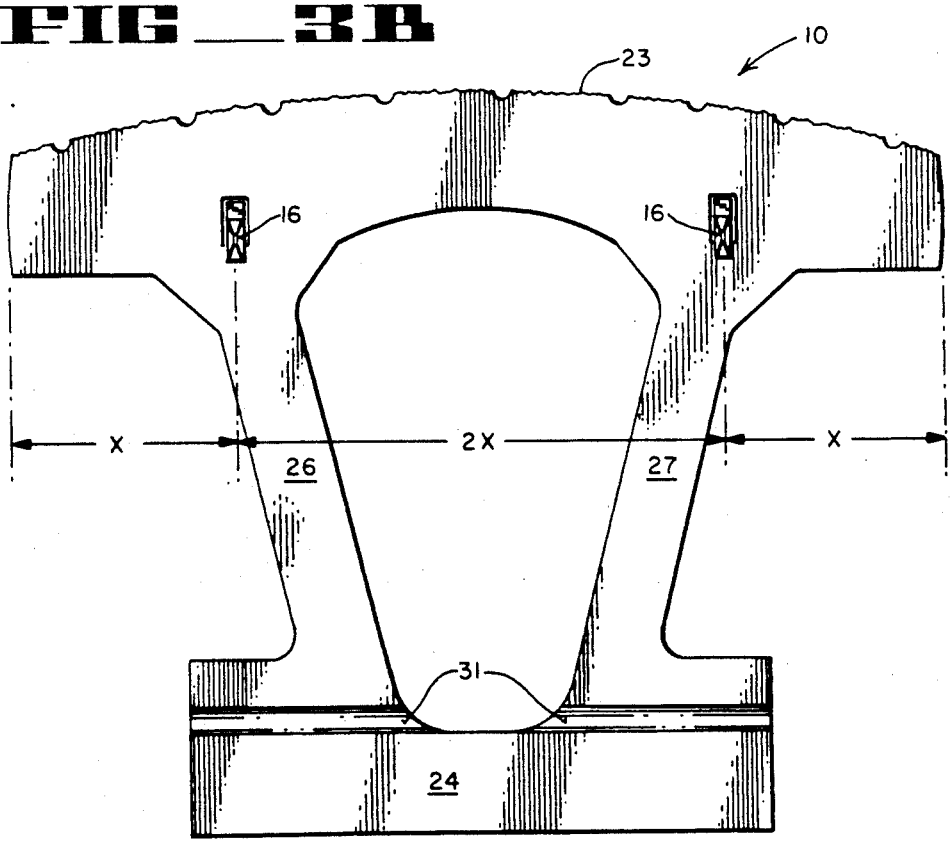
FIG. 3B shows a diagrammatic plan view of a block as shown in FIG. 1.
Figure 7:
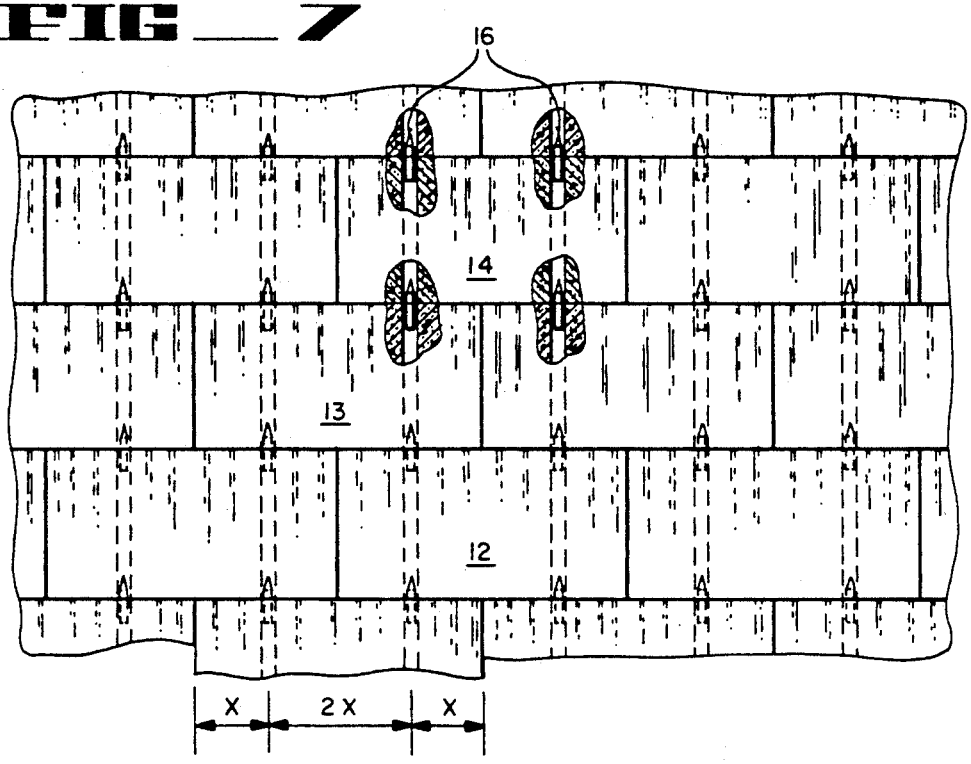
FIG. 7 shows a front elevation view of a retaining wall construction with portions broken away showing the presence of interlocking elements.
Figure 8:
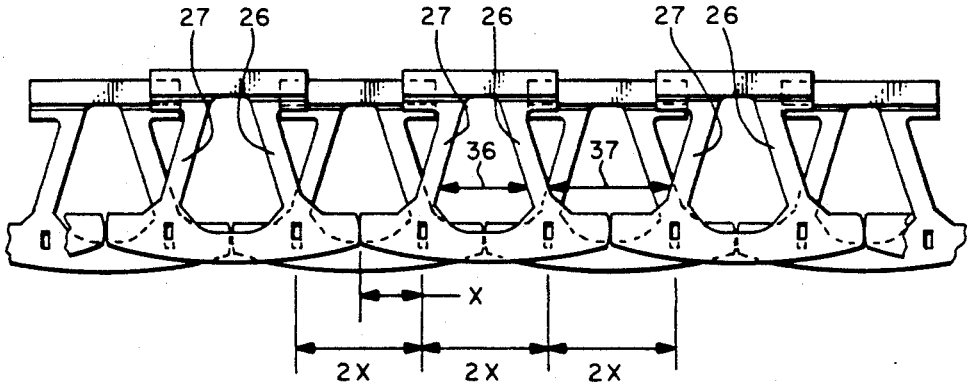
FIG. 8 shows a diagrammatic plan view of the disposition of a plurality of courses of retaining wall blocks for purposes of explanation.

In addition, openings 19, 21 are disposed, as shown in FIGS. 3B, 7 and 8 so that they lie at the so-called quarter points. As thus arranged, the blocks of successive courses can be disposed in running bond.

Figure 4:
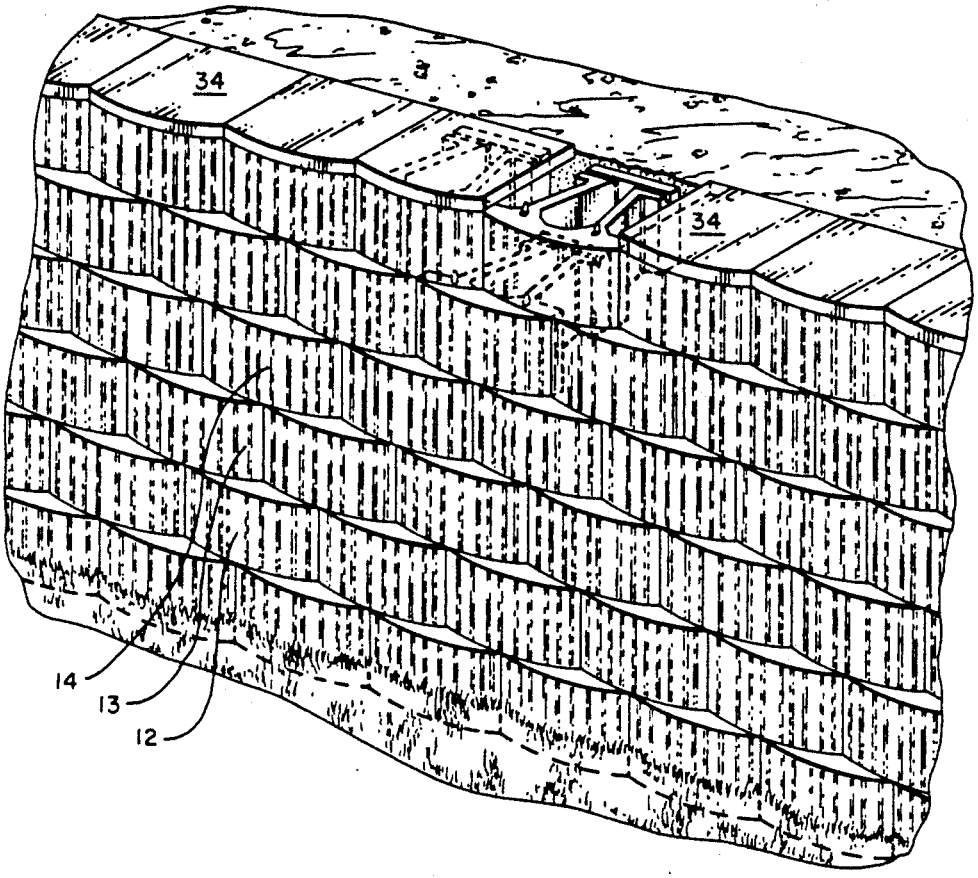
FIG. 4 shows a diagrammatic perspective view of a retaining wall construction made from the blocks shown in FIG. 1.
Figure 5:
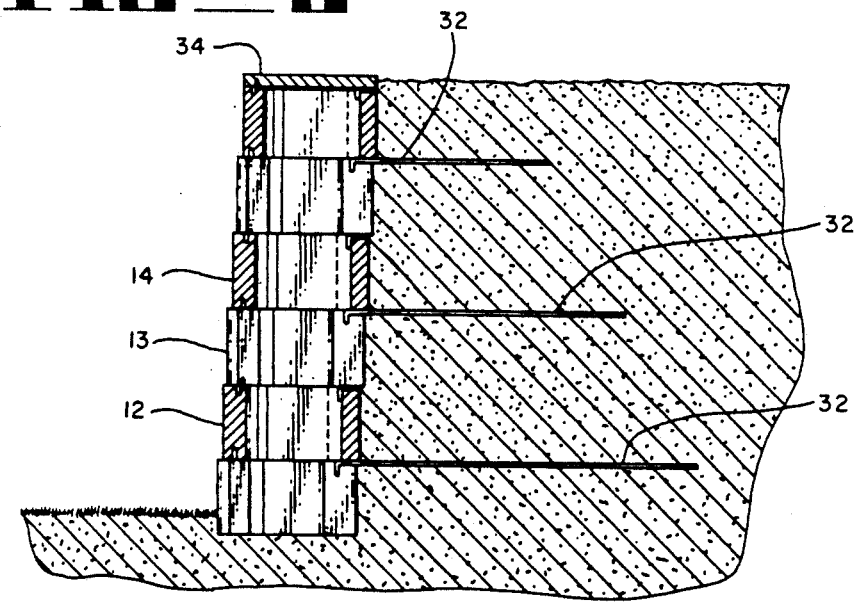
FIG. 5 shows an elevation section view of the retaining wall construction as shown in FIG. 4.

Finally, as shown in FIGS. 4 and 5, the top of the retaining wall is formed by applying a relatively thin cap member 34 to provide a finished appearance to the top surface of the wall.

Based on the foregoing it will be readily evident that there has been provided an improved concrete block and retaining wall formed by a number of such blocks arranged to be interconnected between courses by a plurality of Z-shaped anchors having an upper and lower body part of substantially rectangular cross-section as viewed in plan. The upper body part is offset from the lower body part so as to provide a slight offset of the adjacent upper course of blocks from a lower course of blocks. The amount of this offset will be a predetermined fixed amount in every instance determined by the offset of the body parts of the interlocking anchors.

Accordingly, a retaining wall having a uniform slope will be provided.

In addition, a tie-back arrangement includes a flexible sheet of strong polymer material folded into a slot and retained therein by driving a semi-rigid wedging element, such as a pencil rod 33, between the folded edge margin of the sheet. Accommodation is made for the presence of such a sheet between vertically adjacent blocks so as to inhibit any tipping of the blocks with respect to each other due to the presence of the sheet of material therebetween.

Finally, by securing the edge margin to a trailing portion of the blocks, cells 36, 37 will remain open from above whereby drainage fill material can be deposited therein from above at any stage of construction.

I claim:

1. In a retaining wall construction formed by a number of interlocking concrete blocks, the wall having a predetermined upward slope established by the interlocking means, said construction comprising a first plurality of blocks disposed in line and forming a first row thereof, a second plurality of blocks disposed in line and forming a second row of blocks carried by the first row, said blocks having a top and bottom surface, said blocks of one row overlapping a pair of blocks of another row, and having a pair of openings formed in the top and bottom surfaces of said block, said openings being aligned between those on top and those underneath, a plurality of interlocking elements interposed between blocks of said first and second rows, said elements including first and second elongate body portions, said first body portion having, along the length thereof, a rectangular cross-section as viewed in plan, said second body portion having along a limited extent of the length thereof, a rectangular cross-section as viewed in plan, said rectangular cross-section of said first and second body portions being shaped and dimensioned to fit within said openings to provide a loose fit therein, said second body portion carrying thereon a progressively reduced upper end portion serving to guide said second body portion into an opening exposed underneath one of said blocks being placed thereon, said first portion being offset a predetermined degree from said second body portion to form a step between said first and second body portions, the extent of said step serving to define the degree of the predetermined upward slope of the wall.

2. A retaining wall construction according to claim 1 in which said openings for receiving said interlocking elements are disposed at the quarter points of the blocks.

3. A retaining wall construction according to claim 1 in which said openings on top and bottom of said blocks are formed as a pair of continuous passageways extending from the top surface to the bottom surface of said blocks.

4. A retaining wall construction according to claim 1 further comprising tie-back means coupled to said blocks comprising an elongate slot formed in the top of said blocks at the rear thereof and a flexible sheet retained in said slot by a wedging element driven to move in the plane of said slot.

5. In a retaining wall construction formed by a number of courses of concrete blocks, the wall having a predetermined upward slope, means for interlocking the blocks between courses and serving to define the degree of said slope, said means comprising a plurality of anchor elements, said elements each comprising first and second elongate body parts, said first body part having, along the length thereof a crosssection as viewed in plan having angle means disposed at the periphery thereof so as to cooperate with and fit within an opening on the underside of a block formed to inhibit twisting of said elements within their associated openings receiving said first and second body parts, one of said body parts being offset with respect to the other by a predetermined degree so as to offset successive adjacent courses of blocks in a manner defining the degree of said slope.

6. A wall block for use in making a retaining wall, said block comprising leading and trailing bodies spaced apart, a pair of sidewalls extending between said trailing body and the quarter points of said leading body to form an unobstructed cell therebetween for receiving drainage material therein from above, means carried by said trailing body for securing the leading edge margin of a sheet of tie back material to form a tie back from a wall formed with said blocks said cell remaining unobstructed from above after securing the sheet of tie back material to the block, and interlocking means carried by said leading body at the quarter points of said leading body to protrude therefrom for interengaging the leading body of a second block disposed thereon and serving to inhibit sliding movement therebetween laterally, forwardly and backwardly so as to positively locate the two blocks with respect to one another.

7. A wall block for use in making a retaining wall, said block comprising leading and trailing bodies spaced apart, a pair of sidewalls extending between said bodies and forming an unobstructed cell therebetween for receiving drainage material therein from above, means carried by said trailing body for securing the leading edge margin of a sheet of tie back material to form a tie back from a wall formed with said blocks said cell remaining unobstructed from above after securing the sheet of tie back material to the block, said blocks including top and bottom surfaces and noncircular openings extending vertically through the top and bottom surfaces of said block, said openings being shaped and adapted to receive correspondingly shaped anchor elements therein for interlocking a plurality of blocks stacked upon each other in a manner inhibiting rotation of the anchor elements or mis-orientation of same within their associated openings.

8. A wall block for use in making a retaining wall, said block comprising leading and trailing bodies spaced apart, a pair of sidewalls extending between said bodies and forming an unobstructed cell therebetween for receiving drainage material therein from above, means carried by said trailing body for securing the leading edge margin of a sheet of tie back material to form a tie back from a wall formed with said blocks said cell remaining unobstructed from above after securing the sheet of tie back material to the block said means for securing the leading edge margin comprising an elongate slot formed in said trailing body substantially parallel with the leading edge of a sheet of tie back material, said slot serving to receive a folded edge of the sheet of tie back material, said folded edge containing a wedge captured therein for retaining said edge in said slot when driven into said slot in the plane of said slot.

9. A retaining wall formed from a plurality of blocks according to claim 6 in which side walls of adjacent blocks serve to form open cells therebetween, said last named cells being unobstructed from above for receiving draining fill material therein from above.

* * * * *